US005871076A

United States Patent [19]

Anello et al.

[11] Patent Number: 5,871,076

[45] Date of Patent: Feb. 16, 1999

[54] COIN HANDLING APPARATUS PROTECTION DEVICE

[75] Inventors: Salvatore Anello, Fishkill; Nathan M. Turk, Highland, both of N.Y.

[73] Assignee: Sandt Technology, Ltd., Marlboro, N.Y.

[21] Appl. No.: 729,760

[22] Filed: Oct. 7, 1996

[51] Int. Cl.[6] ..... G07F 1/04

[52] U.S. Cl. ..... 194/347; 379/145

[58] Field of Search ..... 194/202, 344, 194/345, 346, 347, 348, 349; 379/145; 221/193; 232/55, 57, 57.5, 58, 59

[56] References Cited

U.S. PATENT DOCUMENTS 5,279,404 1/1994 Bruner et al. ..... 194/346

*Primary Examiner*—F. J. Bartuska
*Attorney, Agent, or Firm*—Joseph B. Taphorn

[57] ABSTRACT

A coin handling protection device is disclosed which prevents thieves from stuffing compressible material through the coin insert slot and into the coin return chute of coin-operated machines. The device prevents stuffing the coin return chute by incorporating a blocking plate across the top opening of the coin return chute such that compressible material stuffed into the coin insert slot is diverted into the open space within the payphone unit. The device is suitable for use in existing coin handling apparatus.

5 Claims, 4 Drawing Sheets

FIG. 4
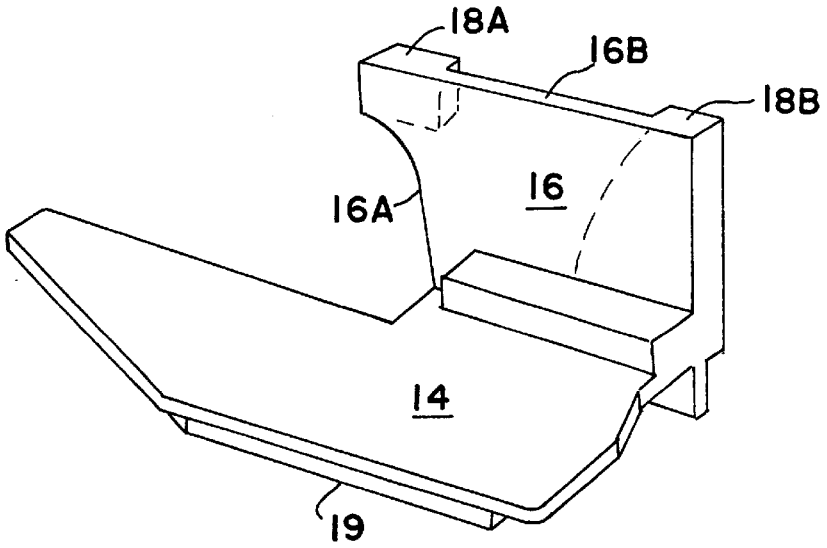
FIG. 5
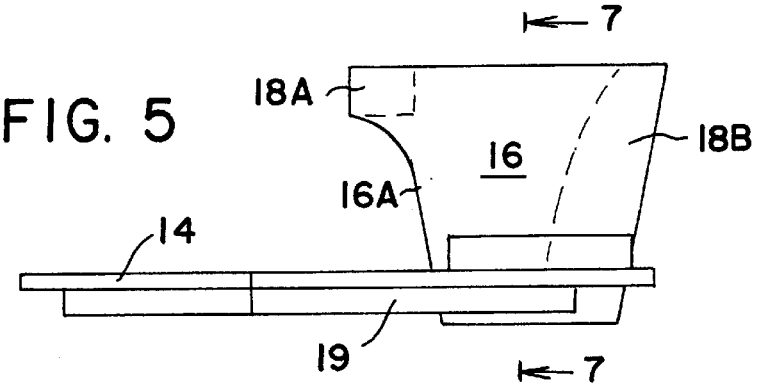
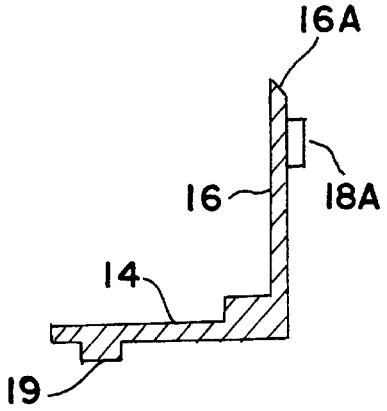
FIG. 7
FIG. 6
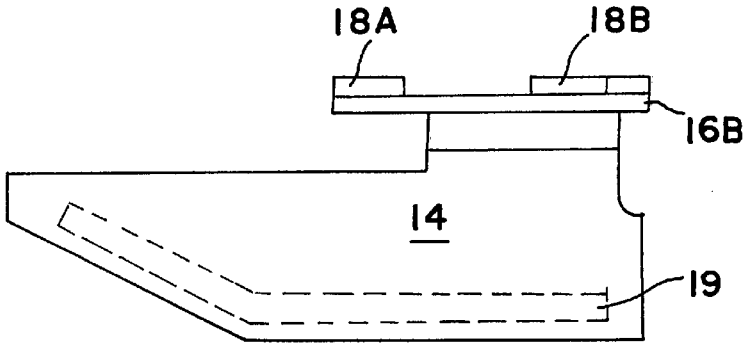

COIN HANDLING APPARATUS PROTECTION DEVICE

BACKGROUND AND OBJECTS OF THE INVENTION

1. Field of the Invention

The present invention relates generally to a coin handling protection device and, more particularly, to a device which can be attached to a standard payphone coin handling apparatus to prevent tampering with the coin handling system.

2. Description of the Prior Art

The payphone coin handling apparatus in use today typically comprises a body having a downwardly-inclined coin chute through which coins are allowed to roll from an inlet end aligned with a coin insert slot. The body further includes a coin validator which provides a means of electronically detecting the authenticity and value of the coin as it rolls down the coin chute. The coin validator may comprise, for example, an "MS16" model coin validator manufactured by Mars Electronics. Alternatively, other types of coin validators may be used to determine the authenticity and value of coins inserted into the payphone, including those functioning mechanically or optically. Depending upon the type and value of the inserted coins and whether the telephone call is completed, the coin validator operates to selectively route the coins to a coin box or a coin return trough. A coin box chute is coupled to the outlet end of the coin chute and receives valid coins which are to be deposited in the coin box. A coin return chute is positioned adjacent to the coin validator and function to receive counterfeit coins or valid coins to be returned to the payphone customer. The coin return chute comprises a hollow body having front and back walls which are joined by opposing side walls. Each of the side walls converge at its bottom end to form a narrow throat at the exit end of the coin return chute. The coin return chute is coupled at its exit end to a coin return trough, from which a customer can retrieve coins returned from the payphone. The top of the coin return chute is open such that it may receive coins from the coin validator.

Theft of coins from payphone coin handling apparatus has been a continuing problem in payphones of the type described above. Initial forms of stuffing coin handling apparatus involved inserting compressible material, such as matchbook covers or slips of paper, through the coin insert slot and thereby lodging the compressible material in the coin chute. The compressible material caused the coin chute to fill up with coins as payphone customers unsuccessfully attempted to use the telephone. The thief retrieved these coins by pushing a coat hanger or other similar object into the coin chute and forcing the coins through an adjacent coin validator and into the coin return chute. These coins would cascade down the coin return chute and into the coin return trough where they would be retrieved by the thief.

Attempts at preventing this type of theft involved designing a coin chute that can be cleared of compressible materials. In particular, the coin chute body comprises two sidewalls pivotally connected along their top edges to a bracket through a pivot pin. Further, the coin chute sidewalls are biased together by a biasing spring positioned along their top edges. A coin release lever is pivotally connected to the exterior of the payphone unit and is coupled by a linkage to the coin chute. When the coin release lever is actuated, the coin chute sidewalls separate and release lodged coins or compressible material into the coin return chute.

While this mechanism has proved successful in preventing stuffing of the coin chute, it has given rise to yet another form of "stuffing." Rather than attempting to stuff the coin chute, thieves revert to stuffing the coin return chute. To "stuff" the coin return chute, the thief inserts compressible material through the coin insert slot and into the coin chute as described above. After the compressible material is lodged in the coin chute, the thief actuates the coin release lever, thereby depositing the compressible material into the coin return chute. Because the coin return chute converges at the exit end, the compressible material settles at the bottom of the coin return chute. The thief repeatedly deposits compressible material into the coin return chute in this manner until a sufficient amount of material collects and blocks the coin return chute exit end. After sufficient time, a sizable number of coins, which would otherwise be returned to the payphone customer, accumulates within the coin return chute behind the compressible material. The thief then pours a combustible fluid through the coin inlet slot and into the coin return chute and ignites the compressible material, thereby allowing the accumulated coins to cascade into the coin return trough for retrieval by thief. This not only means that money which should have been returned to the payphone customers is lost to the thief; but, often the coin handling apparatus is damaged by the ignited compressible material and must be repaired.

The payphone coin handling stuffing problem is an old one and until now no satisfactory solution has been found. This crime costs the phone companies enormous sums of money. Although the phone companies would not normally collect the returned money lost to the "stuffers," the phone companies incur high administrative costs in repairing the payphones and refunding the lost money to irate customers. More specifically, each phone company must employ personnel to investigate reports of payphones failing to return change, employ maintenance workers to examine and repair "stuffed" phones, and have accounting and payment systems in place to refund lost money to payphone customers. Consequently, there is a substantial need for an inexpensive device that reliably prevents stuffing which can be quickly and easily installed in an existing payphone.

OBJECTS OF THE INVENTION

It is therefore an object of the present invention to provide a new coin handling protection device especially suited for use in payphones or coin operated vending machines which are subject to theft by "stuffing" the coin return chute.

Another object of the invention is to provide a coin handling protection device which is simple to construct and inexpensive to manufacture.

Still a further object of the invention is to provide a coin handling protection device that can be quickly and easily installed in existing payphones or coin-operated vending machines yet which is sturdy, durable and completely effective in preventing "stuffing" the coin return chute with foreign material.

The accompanying drawings, referred to herein and constituting a part hereof, illustrate preferred embodiments of the invention, and together with the description, serve to explain the principles of the invention.

BRIEF DESCRIPTION OF THE DRAWINGS

FIG. 4 shows a device of the present invention.

FIG. 5 shows a front view of the device of the present invention.

FIG. 6 shows a plan view of the device of the present invention.

FIG. 7 shows a cross-sectional view of the present invention along 7—7 provided in FIG. 5.

DESCRIPTION OF THE PREFERRED EMBODIMENTS

Referring now more particularly to FIGS. 1–7 of the accompanying drawings, there is illustrated a preferred embodiment of a coin handling protection device constructed in accordance with the present invention. As hereby preferably embodied, the machine is advantageously adapted for use in public payphone coin handling apparatus.

While the device of our invention as here embodied is particularly adapted to and was designed for use in public payphone coin handling apparatus, the principles of operation of the invention are not limited to such usage. However, since the invention is especially suitable for such usage, reference will be made hereinafter thereto in order to provide an example of a practical and useful embodiment of the invention.

It will be understood that the present invention is not limited to use in payphones, but may be adapted for use in other types of coin-operated machinery by slight changes in dimensions.

Figure 1:
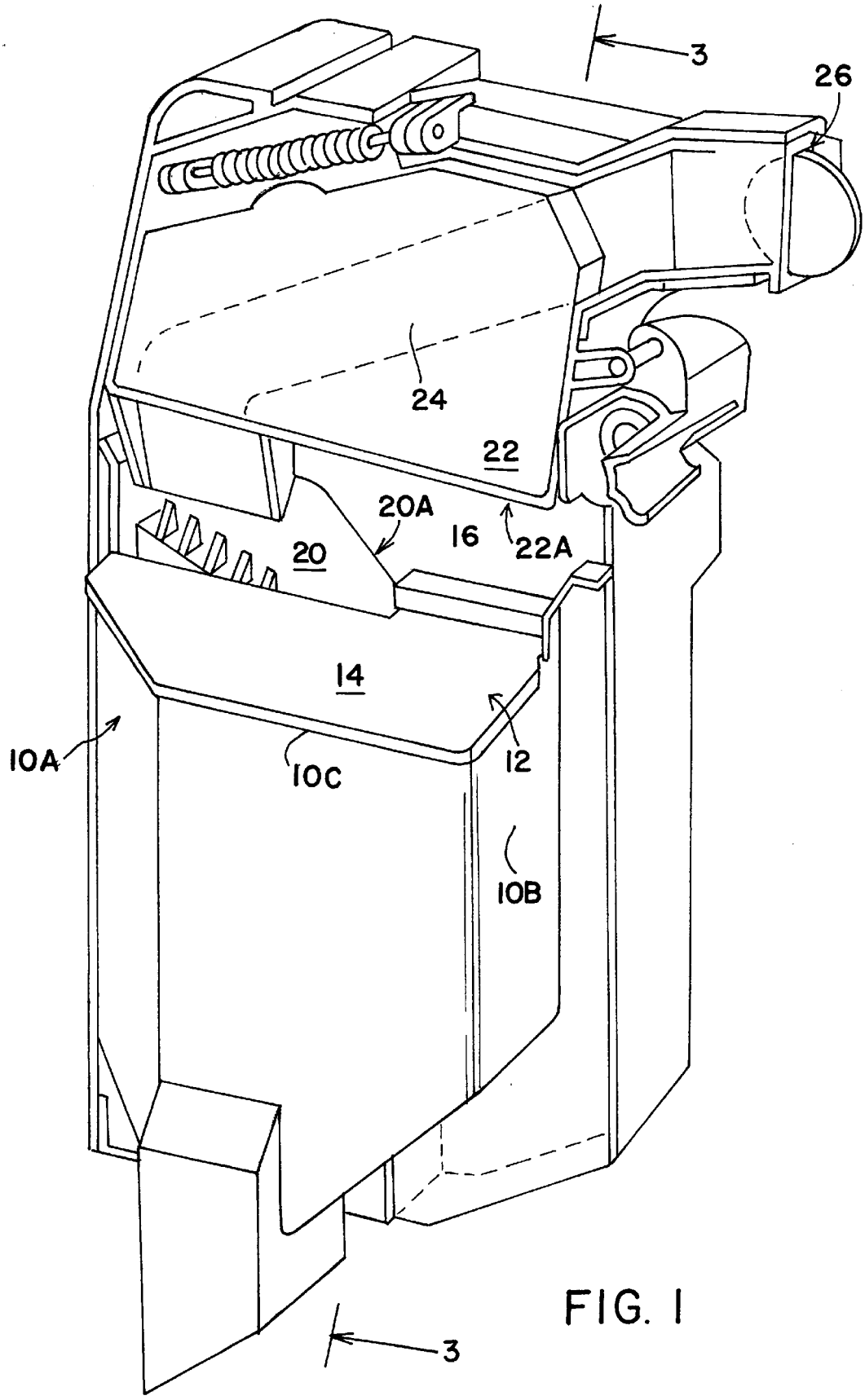
FIG. 1 shows a prospective view of an existing payphone coin handling apparatus with the device of the present invention.
Figure 2:
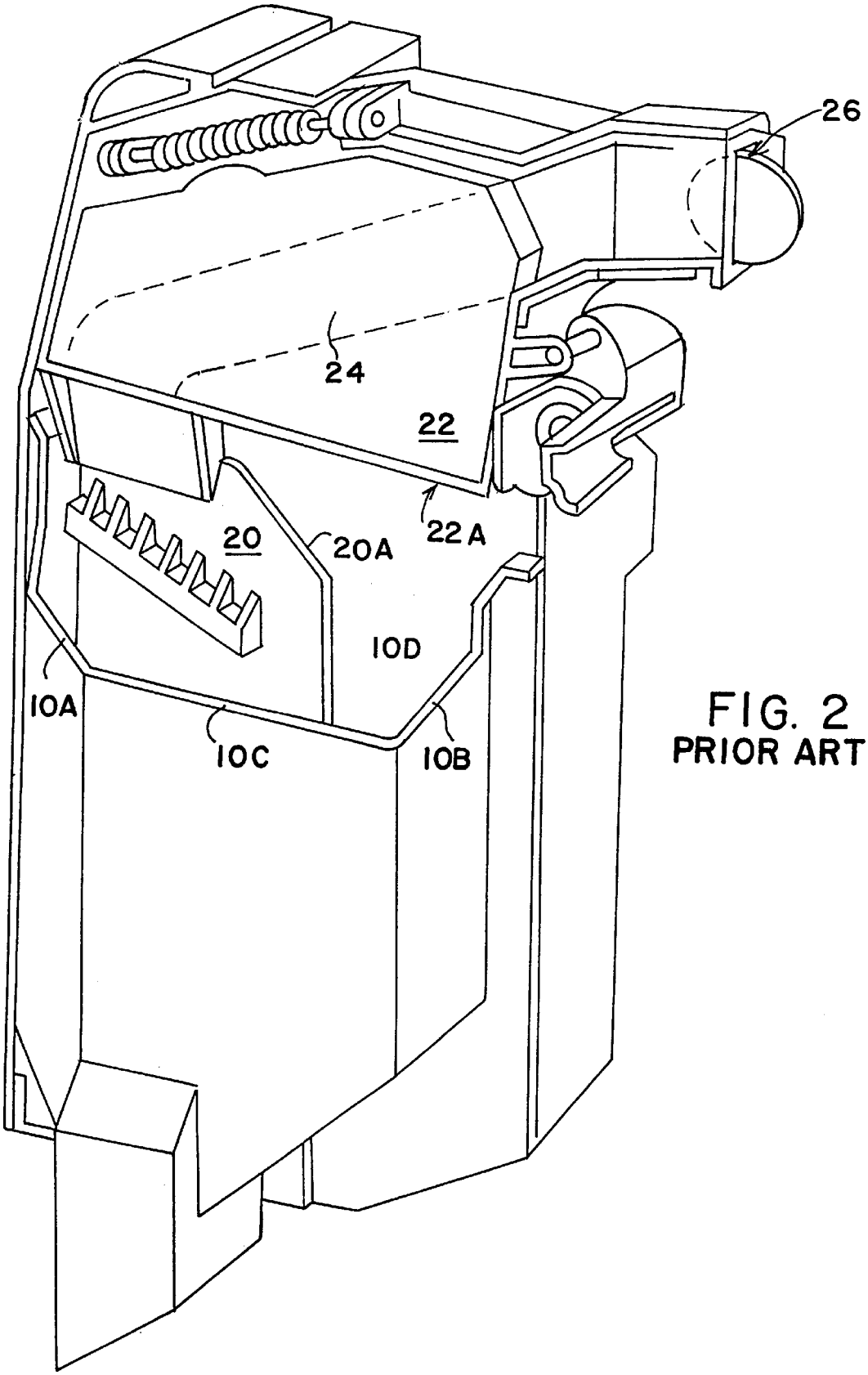
FIG. 2 PRIOR ART
FIG. 2 shows a prospective view of an existing payphone coin handling apparatus.

FIG. 1 depicts the preferred embodiment of the present invention. The first side wall 10*a*, second side wall 10*b* and front wall 10*c* of coin return chute 10, an existing component of a coin handling apparatus, serve as the anchor to which the invention is mounted. The invention comprises blocking plate 12.

Blocking plate 12 has two regions, a horizontal flat region 14 and a vertical flat region 16. It can be made of a single piece of material or several pieces of material which have been joined. Blocking plate 12 can be molded or made from thermoplastic or thermoset resins or metallic plates such as aluminum or stainless steel plates. The particular material from which the blocking plate 12 is made is not important as long as it is of sufficient strength and thickness.

Figure 3:
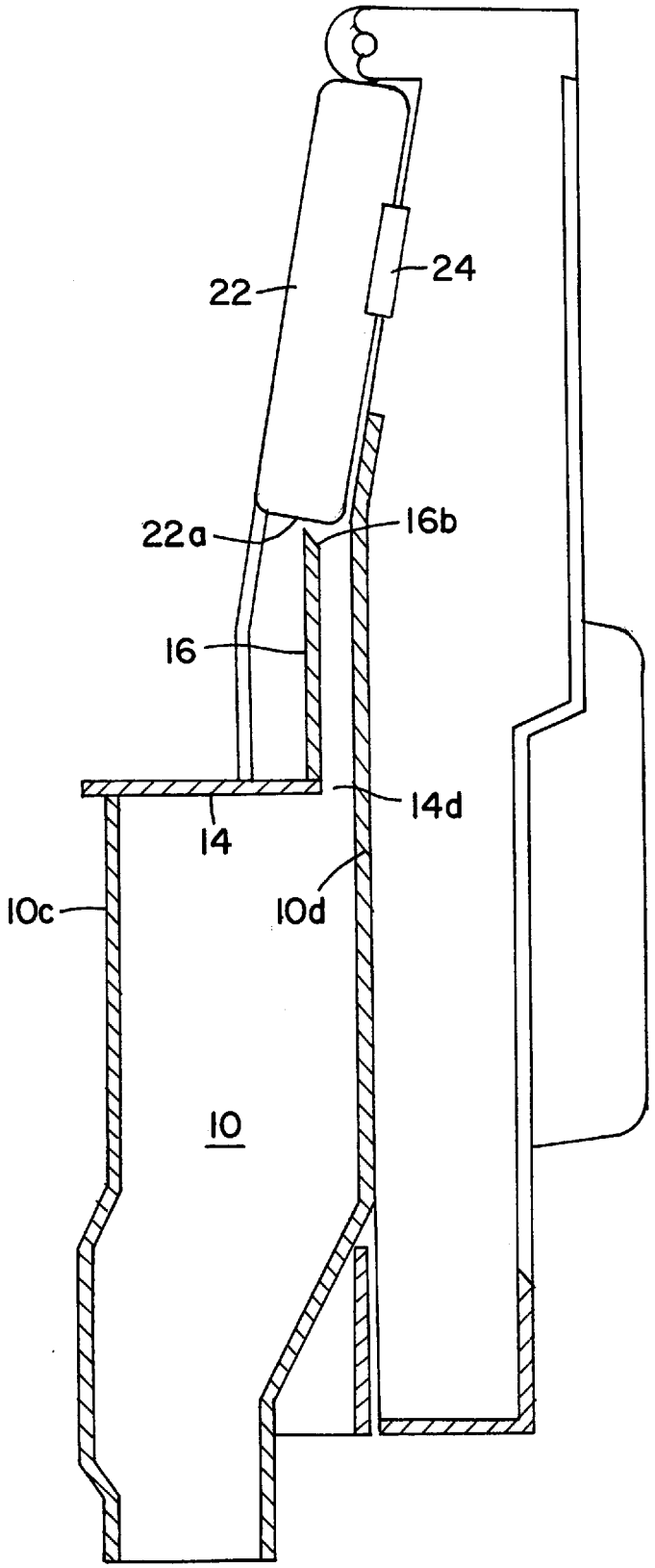
FIG. 3 shows a cross-sectional view of an existing payphone coin handling apparatus with the device of the present invention along 3—3 as provided in FIG. 1.

Horizontal flat region 14 is configured such that it essentially completely covers the coin return chute opening defined by first side wall 10*a*, second side wall 10*b*, front wall 10*c*, back wall 10*d* and coin box chute front wall 20. As shown in FIG. 3, the back edge 14*d* of horizontal flat region 14 does not completely extend to back wall 10*d* but provides sufficient space to accomodate the thickness of a "quarter" such that a returned coin may pass between back edge 14*d* and back wall 10*d*. Vertical flat region 16 is attached at a 90° angle to the back edge 14*d* of horizontal flat region 14. If vertical flat region 16 and horizontal flat region 14 are made of thermoplastic or thermoset resins, they may be attached by means of adhesives. If vertical flat region 16 and horizontal flat region 14 are made of metal, they may be attached by means of welding, soldering or other attachment means. Further, vertical flat region 16 and horizontal flat region 14 may be molded in one piece. Referring now to FIGS. 1 and 3, vertical flat region 16 is configured such that inner edge 16*a* follows the contours of and mates closely with inner edge 20*a* of coin box chute front wall 20 and upper edge 16*b* extends upward to a position slightly below a bottom edge 22*a* of coin chute inner side wall 22. As shown in FIG. 3, upper edge 16*b* of vertical flat region 16 is bevelled outwardly such that a returned coin falls from coin chute 24, engages upper edge 16*b*, is directed between the back side of vertical flat region 16 and back wall 10*d* of the coin return chute and drops into coin return chute 10.

Referring now to FIGS. 4–7, vertical flat region 16 preferably includes a first spacer 18*a* and a second spacer 18*b* which provide adequate spacing between vertical flat region 16 and back wall 10*d* such that a quarter may pass from coin chute 24, between vertical flat region 16 and back wall 10*d*, and into coin return chute 10. In addition, first spacer 18*a* and second spacer 18*b* combine to provide a channel through which returned coins can pass from coin chute 24, between vertical flat region 16 and back wall 10*d*, and into coin return chute 10. First spacer 18*a* and second spacer 18*b* may be generally rectangular or circular in shape and are of sufficient thickness to provide adequate clearance for a coin such as a quarter to pass width-wise between horizontal flat region 16 and back wall 10*d*. First spacer 18*a* is positioned at the upper left corner on the Lack of vertical flat region 16. Similarly, second spacer 18*b* is positioned at the upper right corner on the back of vertical flat region 16. First spacer 18*a* and second spacer 18*b* must be positioned and dimensioned so as to create a channel between the first spacer 18*a* and the second spacer 18*b* of sufficient width to allow the passage of a coin, such as a quarter. If first spacer 18*a* and second spacer 18*b* are made of thermoplastic or thermoset resins, they may be attached to vertical flat region 16 by means of adhesives. If first spacer 18*a* and second spacer 18*b* are made of metal, they may be attached to vertical flat region 16 by means of welding, soldering or other attachment means. Further, first spacer 18*a* and second spacer 18*b* may be molded in one piece with vertical flat region 16.

The bottom of the horizontal flat region 14 preferably includes an extension 19 which is dimensioned to follow the contours of coin return chute front wall 10*c* and first side wall 10*a* such that extension 19 functions to stabilize blocking plate 12. If extension 19 and horizontal flat region are made of thermoplastic or thermoset resins, they made be attached by means of adhesive. If extension 19 and horizontal flat region 16 are made of metal, they may be attached by means of welding, soldering or other attachment means. Further, extension 19 and horizontal flat region may be molded in one piece. Alternatively, the bottom of horizontal flat region 14 may include a groove of sufficient width and depth to engage the top edges of first side wall 10*a*, second side wall 10*b* and front wall 10*c* of coin return chute 10, and thereby function to stabilize blocking plate 12.

Those skilled in the art will readily appreciate that if payphones have different coin handling apparatus dimensions or configurations, the size and shape of blocking plate 12 will have to be correspondingly adjusted.

The invention in its broader aspects is not limited to the specific embodiments herein shown and described but departures may be made therefrom within the scope of the accompanying claims, without departing from the principles of the invention and without sacrificing its chief advantages.

We claim:

1. In a coin handling apparatus for use in a coin operated machine with a coin insert slot, a coin chute having an inner side wall and an outer side wall, a coin validator, a coin box chute having a front wall with an inner edge and an outer edge, and a coin return chute having an open top end formed by a front wall, a back wall, the coin box chute front wall, a first side wall and a second side wall, wherein the impovement comprises a blocking plate means for preventing a compressible material from falling into the open top end of the coin return chute, but allowing a coin to pass into the coin return chute, said blocking plate means includes:

(a) a horizontal flat region which is configured to span essentially completely the area from the first side wall to the second side wall and from the front wall of the coin return chute to a distance from the back wall slightly greater than the width of a quarter, such that a quarter may pass between a back edge of the horizontal flat region and the back wall; and (b) a vertical flat region which is attached at a lower edge to the back edge of the horizontal flat region and is configured to span essentially completely the area from the back edge of the horizontal flat region to a bottom edge of the inner side wall of the coin chute and from the inner edge of the coin box chute front wall to a front wall of the coin handling apparatus, wherein an upper edge of the vertical flat region is bevelled outwardly such that a returned coin engages the upper edge and is directed between the vertical flat region and the back wall and into the coin return chute, wherein the vertical flat region further comprises:

(a) a first spacer attached to the upper left corner on a back side of the vertical flat region; and (b) a second spacer attached to the upper right corner on a back side of the vertical flat region such that the first spacer and the second spacer are of sufficient thickness to provide adequate clearance such that a quarter can pass width-wise between the vertical flat region and the back wall and are of such shape and dimension to combine to form a channel of sufficient width to allow a quarter to pass length-wise.

2. The improved coin handling apparatus according to claim 1, wherein the horizontal flat region further comprises an extension attached to a bottom side of the horizontal flat region and which follows the contours of and is attached to the front wall and the first side wall of the coin chute to provide greater stability for the blocking plate means.

3. The improved coin handling apparatus according to claim 2, wherein the coin-operated machine is a payphone.

4. The improved coin handling apparatus according to claim 1, wherein the horizontal flat region further comprises a groove in a bottom side of the horizontal flat region of dimensioned to follow the contours of coin return chute front wall and first side wall and of sufficient width and depth to engage the top edges of the coin return chute front wall and first side wall to provide greater stability for the blocking plate means.

5. The improved coin handling apparatus according to claim 4, wherein the coin-operated machine is a payphone.

* * * * *